US009682456B1

(12) United States Patent
McGeary

(10) Patent No.: US 9,682,456 B1
(45) Date of Patent: Jun. 20, 2017

(54) APPARATUS FOR AND METHOD OF PROCESSING AN EDGE OF A TUBE

(71) Applicant: The Boeing Company, Chicago, IL (US)

(72) Inventor: Mark E. McGeary, Lake Stevens, WA (US)

(73) Assignee: The Boeing Company, Chicago, IL (US)

( * ) Notice: Subject to any disclaimer, the term of this patent is extended or adjusted under 35 U.S.C. 154(b) by 94 days.

(21) Appl. No.: 14/044,340

(22) Filed: Oct. 2, 2013

(51) Int. Cl.
*B24B 9/00* (2006.01)
*B24B 55/05* (2006.01)

(52) U.S. Cl.
CPC ..... *B24B 9/007* (2013.01)

(58) Field of Classification Search
CPC ..... B24B 9/007; B24B 9/00; B24B 27/76; B24B 37/42; B24B 37/04
USPC ..... 451/464–466, 486, 59, 61, 51, 27
See application file for complete search history.

(56) References Cited

U.S. PATENT DOCUMENTS 1,963,040 A * 6/1934 Wommer ..... B24B 15/00 451/431
3,118,162 A * 1/1964 Karr ..... F28G 3/04 15/104.095
5,170,592 A * 12/1992 Boulton ..... B24B 33/086 451/479
5,259,144 A * 11/1993 Yeh ..... B24B 15/02 451/271
6,106,370 A * 8/2000 Carter ..... B08B 9/021 451/440
6,553,601 B1 * 4/2003 Major ..... 15/104.04
6,704,964 B2 * 3/2004 Knowles ..... 15/104.04
6,986,184 B1 * 1/2006 Chamblee ..... B08B 1/04 15/104.04

* cited by examiner

*Primary Examiner* — Larry E Waggle, Jr.
*Assistant Examiner* — Lauren Beronja
(74) *Attorney, Agent, or Firm* — Kwan & Olynick LLP

(57) ABSTRACT

An abrading apparatus for processing an edge of a tube is disclosed. The abrading apparatus includes a rotational symmetry axis and a chassis comprising an input side, an output side opposite the input side, and an input coupler on the input side of the chassis. The input coupler is coaxial with the rotational symmetry axis. The abrading apparatus also includes a centering member, coupled to the output side of the chassis and coaxial with the rotational symmetry axis, and abrasive members, coupled to the output side of the chassis. The abrasive members define an abrasive face radially spaced outwardly from and generally symmetric about the rotational symmetry axis and facing in a direction generally parallel to the rotational symmetry axis.

18 Claims, 10 Drawing Sheets

APPARATUS FOR AND METHOD OF PROCESSING AN EDGE OF A TUBE

BACKGROUND

Tubes undergoing fabrication may require processing of their end-surface edges, where processing may include deburring or other abrasion-based treatments. Known methods of processing the edges of tubes, such as by manually using files and other tools, may be objectionably time consuming and may produce inconsistent results.

SUMMARY

Accordingly, an abrading apparatus for processing edges of tubes, intended to address the above-identified concerns, would find utility.

One example of the present disclosure relates to an abrading apparatus for processing an edge of a tube. The abrading apparatus includes a rotational symmetry axis and a chassis, having an input side, an output side opposite the input side, and an input coupler on the input side of the chassis. The input coupler is coaxial with the rotational symmetry axis. The abrading apparatus also includes a centering member, coupled to the chassis on the output side thereof and coaxial with the rotational symmetry axis, and abrasive members coupled to the chassis on the output side thereof. The abrasive members define an abrasive face radially spaced outwardly from and generally symmetric about the rotational symmetry axis and facing in a direction generally parallel to the rotational symmetry axis.

Another example of the present disclosure relates to an abrading apparatus for processing edges of tubes. The abrading apparatus includes a rotational symmetry axis and a chassis comprising an input side, an output side opposite the input side, and an input coupler on the input side of the chassis. The input coupler is coaxial with the rotational symmetry axis. The abrading apparatus also includes centering members configured to be selectively and alternatively coupled to the chassis on the output side thereof and to be coaxial with the rotational symmetry axis. At least one centering member and at least another centering member have different transverse dimensions The abrading apparatus also includes abrasive members coupled to the chassis on the output side thereof. The abrasive members define an abrasive face radially spaced outwardly from and generally symmetric about the rotational symmetry axis and facing in a direction generally parallel to the rotational symmetry axis.

Yet another example of the present disclosure relates to a method of processing an edge of a tube, which has a symmetry axis and a central cavity. The method includes providing a chassis with abrasive members that include an abrasive face; generally coaxially aligning the chassis with the symmetry axis from inside the central cavity, with the abrasive face offset from and facing along the symmetry axis; and urging the abrasive face and the edge of the tube against each other while rotating the chassis and the tube relative to each other.

BRIEF DESCRIPTION OF THE DRAWINGS

Having thus described examples of the disclosure in general terms, reference will now be made to the accompanying drawings, which are not necessarily drawn to scale, and wherein like reference characters designate the same or similar parts throughout the several views, and wherein:

FIG. 1 is a flow diagram of aircraft production and service methodology;

FIG. 2 is a block diagram of an aircraft.

FIG. 3 is a block diagram of an abrading apparatus, according to one aspect of the present disclosure;

FIG. 4 is a partially exploded sectional perspective view of an abrading apparatus, according to one aspect of the disclosure;

FIG. 5 is an environmental sectional side view of an abrading apparatus, according to one aspect of the disclosure;

FIG. 6 is an environmental sectional side view of an abrading apparatus, according to one aspect of the disclosure;

FIG. 7 is an end view of an abrading apparatus, according to one aspect of the disclosure;

FIG. 8 is an exploded detail side view of an abrading apparatus, illustrating a mounting arrangement of an abrasive member thereof, according to one aspect of the disclosure;

FIG. 9 is an exploded detail side view of an abrading apparatus, illustrating a mounting arrangement of an abrasive member thereof, according to one aspect of the disclosure;

FIG. 10 is an exploded detail side view of an abrading apparatus, illustrating a mounting arrangement of an abrasive member thereof, according to one aspect of the disclosure;

FIG. 11 is an exploded detail side view of an abrading apparatus, illustrating a mounting arrangement of a centering member thereof, according to one aspect of the disclosure;

Figure 16:
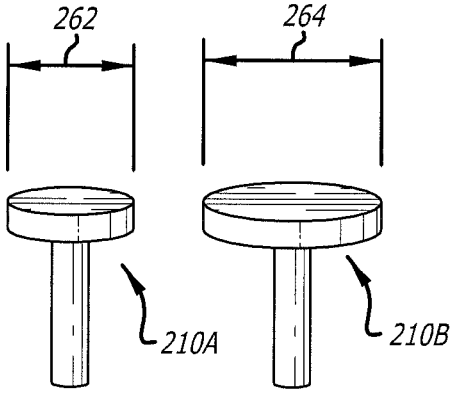
Figure 12:
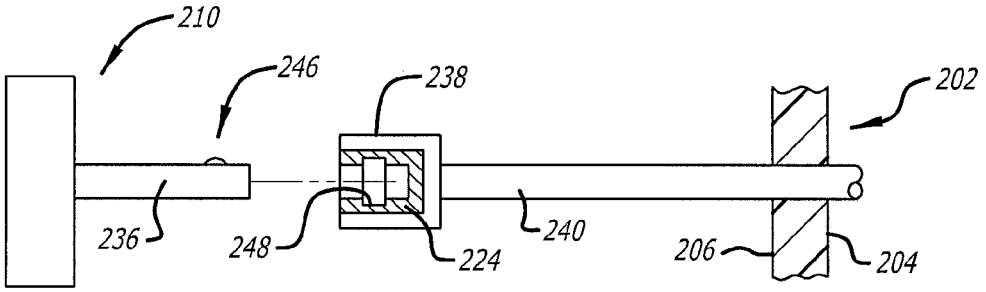
Figure 13:
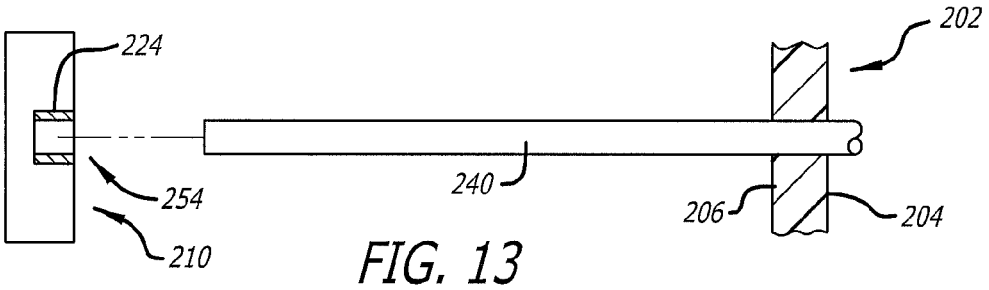
Figure 14:
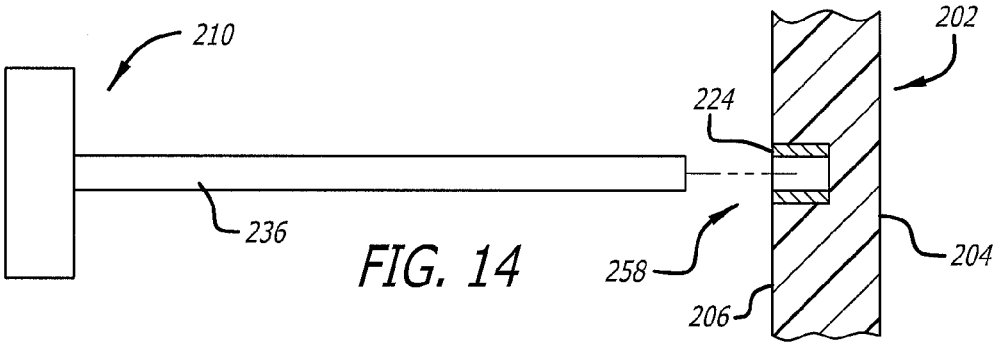
Figure 15:
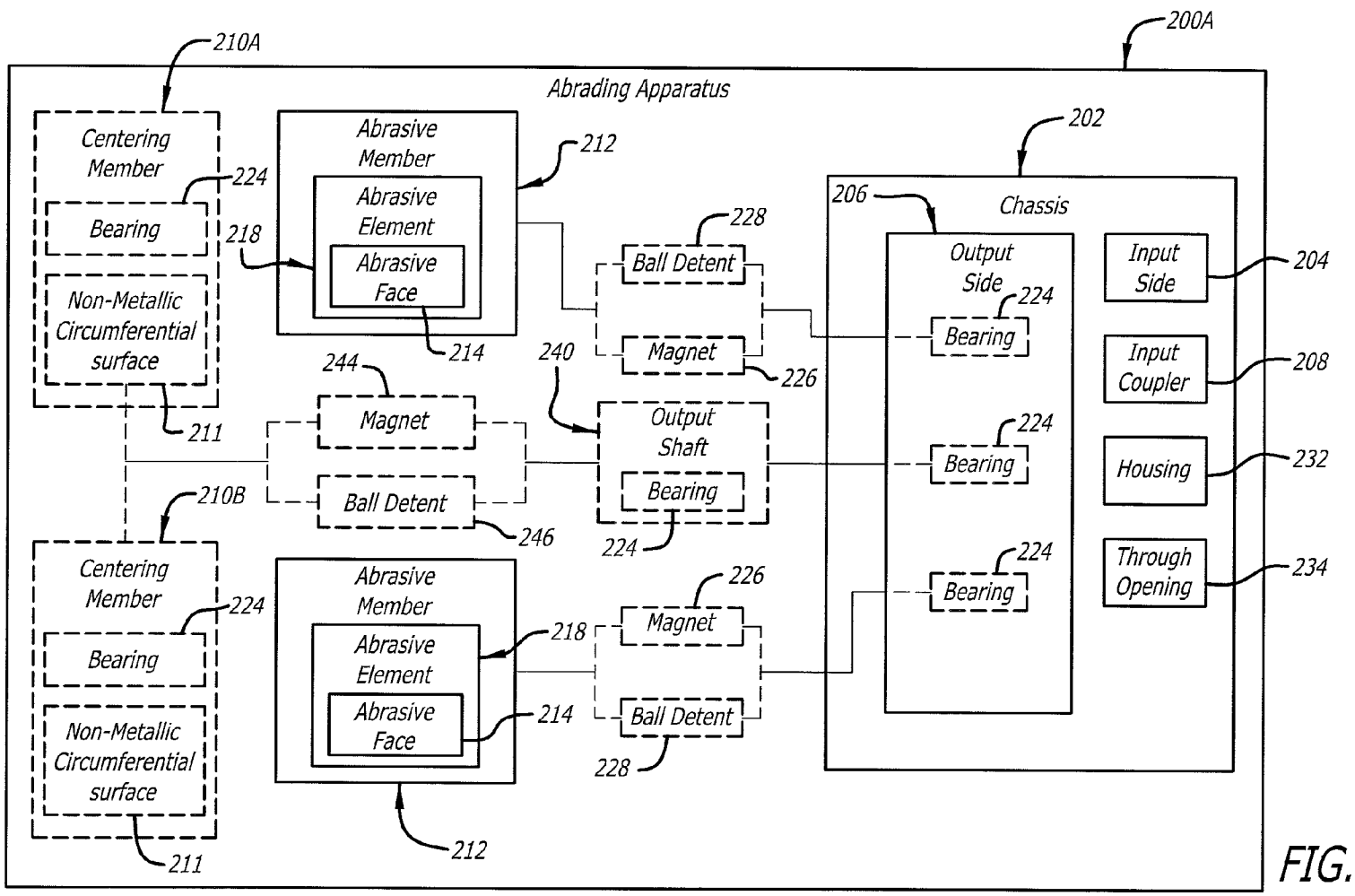
Figure 17:
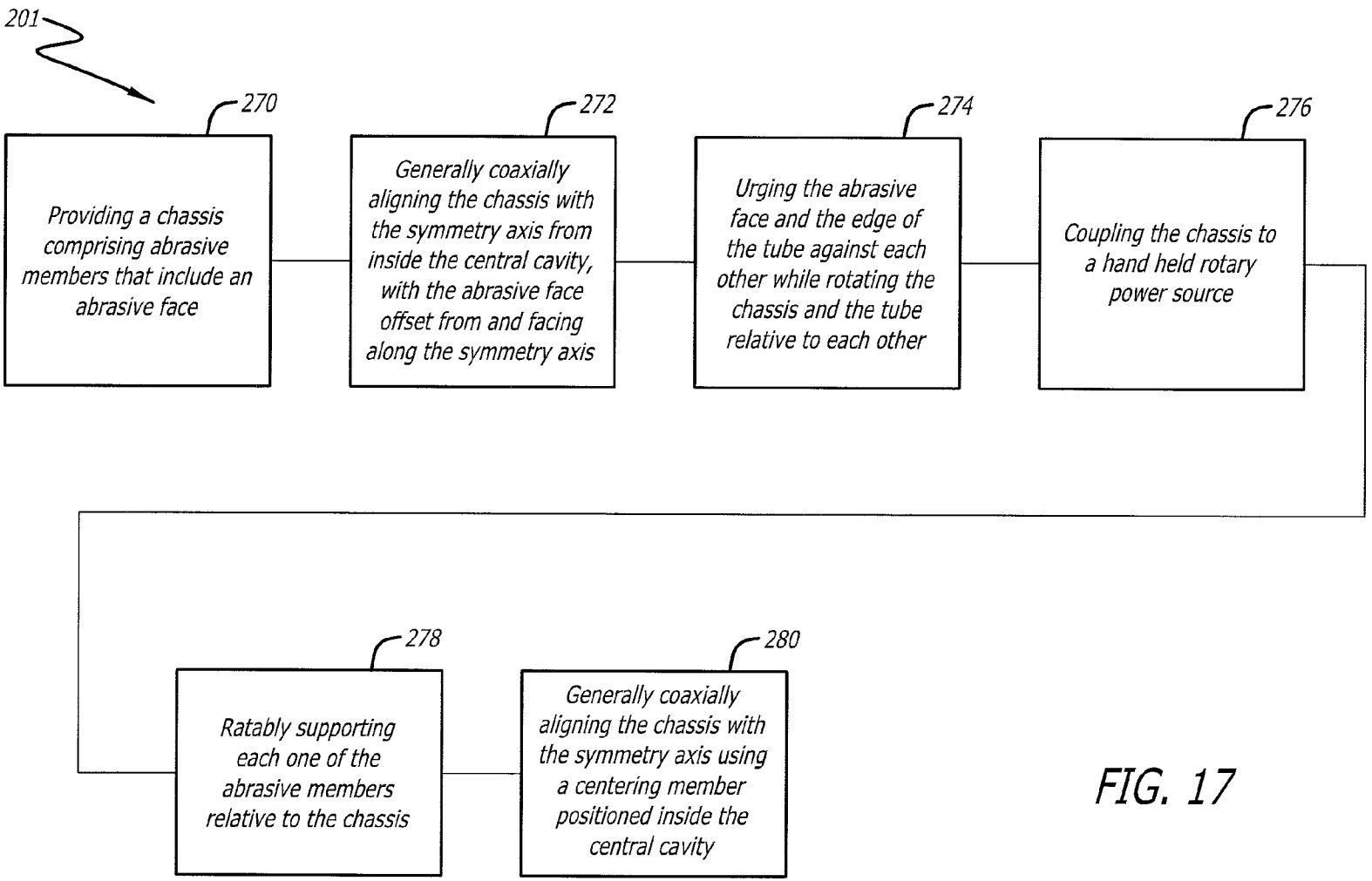

FIG. 12 is an exploded detail side view of an abrading apparatus, illustrating a mounting arrangement of a centering member thereof, according to one aspect of the disclosure;

FIG. 13 is an exploded detail side view of an abrading apparatus, illustrating a mounting arrangement of a centering member thereof, according to one aspect of the disclosure;

FIG. 14 is an exploded detail side view of an abrading apparatus, illustrating a mounting arrangement of a centering member thereof, according to one aspect of the disclosure;

FIG. 15 is a block diagram of an abrading apparatus, according to one aspect of the disclosure;

FIG. 16 is a perspective view of two alternative centering members, according to one aspect of the disclosure; and FIG. 17 is a block diagram of a method of using an abrading apparatus according to one aspect of the disclosure.

In the block diagrams referred to above, solid lines connecting various elements and/or components may represent mechanical, electrical, fluid, optical, electromagnetic and other couplings and/or combinations thereof. As used herein, "coupled" means associated directly as well as indirectly. For example, a member A may be directly associated with a member B, or may be indirectly associated therewith, e.g., via another member C. Couplings other than those depicted in the block diagrams may also exist. Dashed lines, if any, connecting the various elements and/or components represent couplings similar in function and purpose to those represented by solid lines; however, couplings represented by the dashed lines are either selectively provided or relate to alternative or optional aspects of the disclosure. Likewise, any elements and/or components, represented with dashed lines, indicate alternative or optional aspects of the disclosure. Environmental elements, if any, are represented with dotted lines.

DETAILED DESCRIPTION

Figure 1:
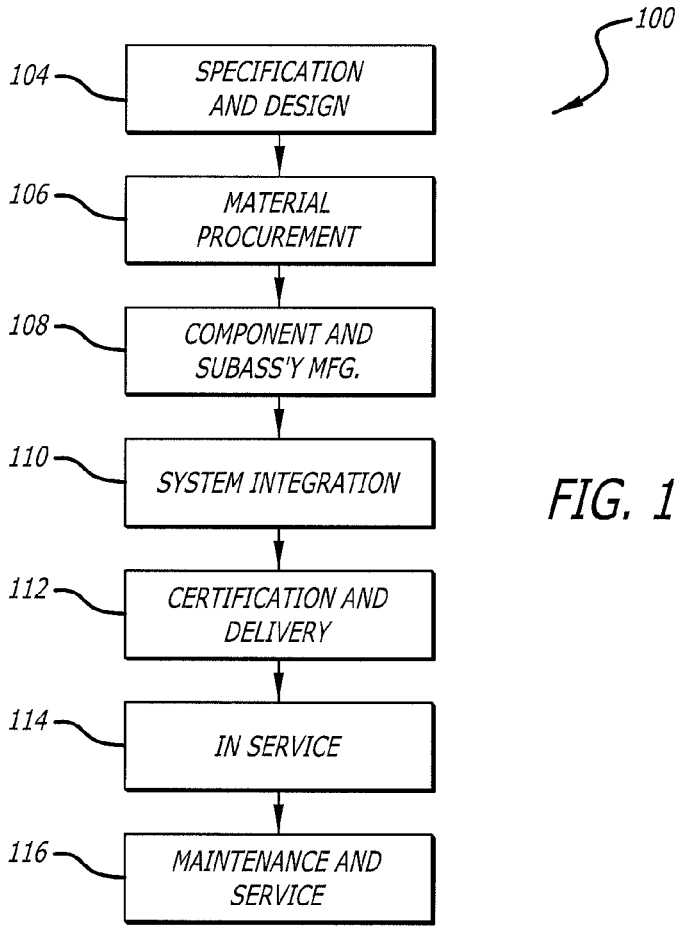
Figure 2:
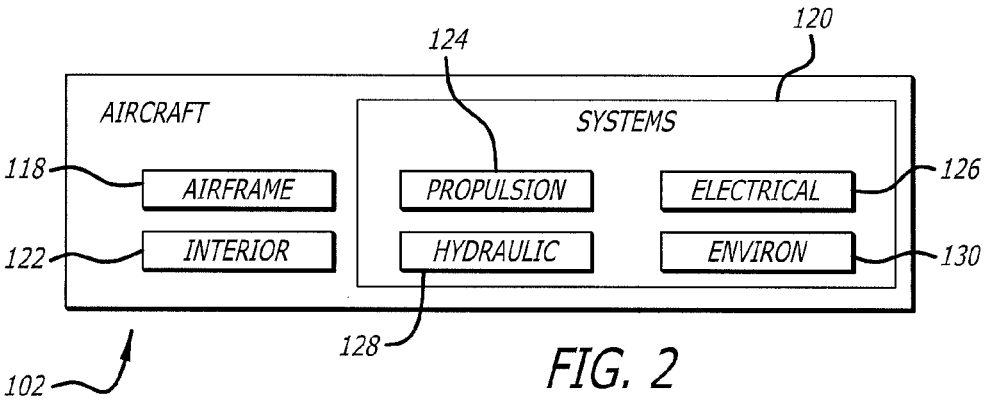
Figure 3:
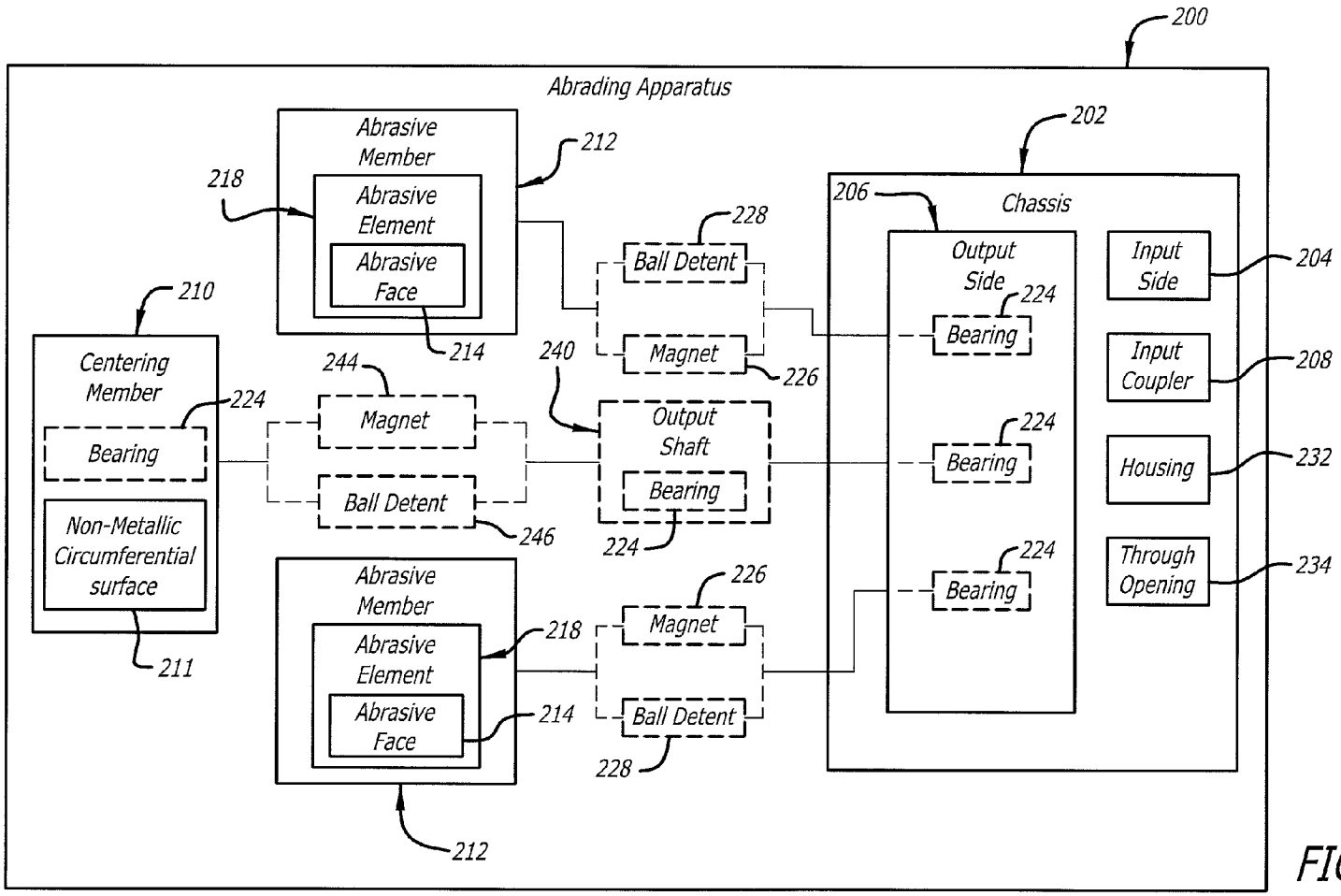

Examples of the disclosure may be described in the context of an aircraft manufacturing and service method 100 as shown in FIG. 1 and an aircraft 102 as shown in FIG. 2. During pre-production, illustrative method 100 may include specification and design 104 of the aircraft 102 and material procurement 106. During production, component and subassembly manufacturing 108 and system integration 110 of the aircraft 102 take place. Thereafter, the aircraft 102 may go through certification and delivery 112 to be placed in service 114. While in service by a customer, the aircraft 102 is scheduled for routine maintenance and service 116 (which may also include modification, reconfiguration, refurbishment, and so on).

Each of the processes of the illustrative method 100 may be performed or carried out by a system integrator, a third party, and/or an operator (e.g., a customer). For the purposes of this description, a system integrator may include, without limitation, any number of aircraft manufacturers and major-system subcontractors; a third party may include, without limitation, any number of vendors, subcontractors, and suppliers; and an operator may be an airline, leasing company, military entity, service organization, and so on.

As shown in FIG. 2, the aircraft 102 produced by the illustrative method 100 may include an airframe 118 with a plurality of high-level systems 120 and an interior 122. Examples of high-level systems 120 include one or more of a propulsion system 124, an electrical system 126, a hydraulic system 128, and an environmental system 130. Any number of other systems may be included. Although an aerospace example is shown, the principles of the invention may be applied to other industries, such as the automotive industry.

Apparatus and methods shown or described herein may be employed during any one or more of the stages of the manufacturing and service method 100. For example, components or subassemblies corresponding to component and subassembly manufacturing 108 may be fabricated or manufactured in a manner similar to components or subassemblies produced while the aircraft 102 is in service. Also, one or more aspects of the apparatus, method, or combination thereof may be utilized during the production states 108 and 110, for example, by substantially expediting assembly of or reducing the cost of an aircraft 102. Similarly, one or more aspects of the apparatus or method realizations, or a combination thereof, may be utilized, for example and without limitation, while the aircraft 102 is in service, e.g., maintenance and service 116.

Figure 4:
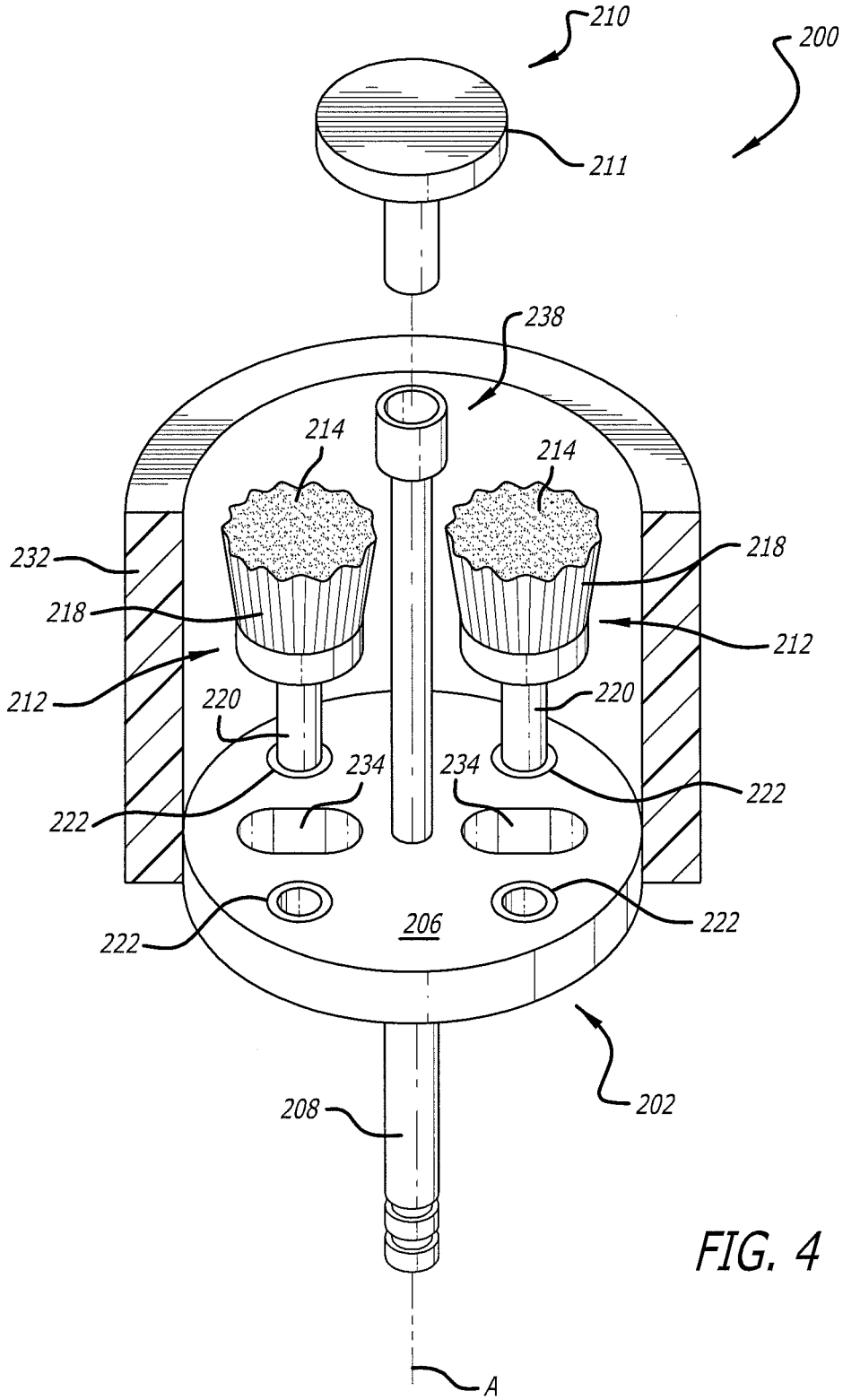
Figure 5:
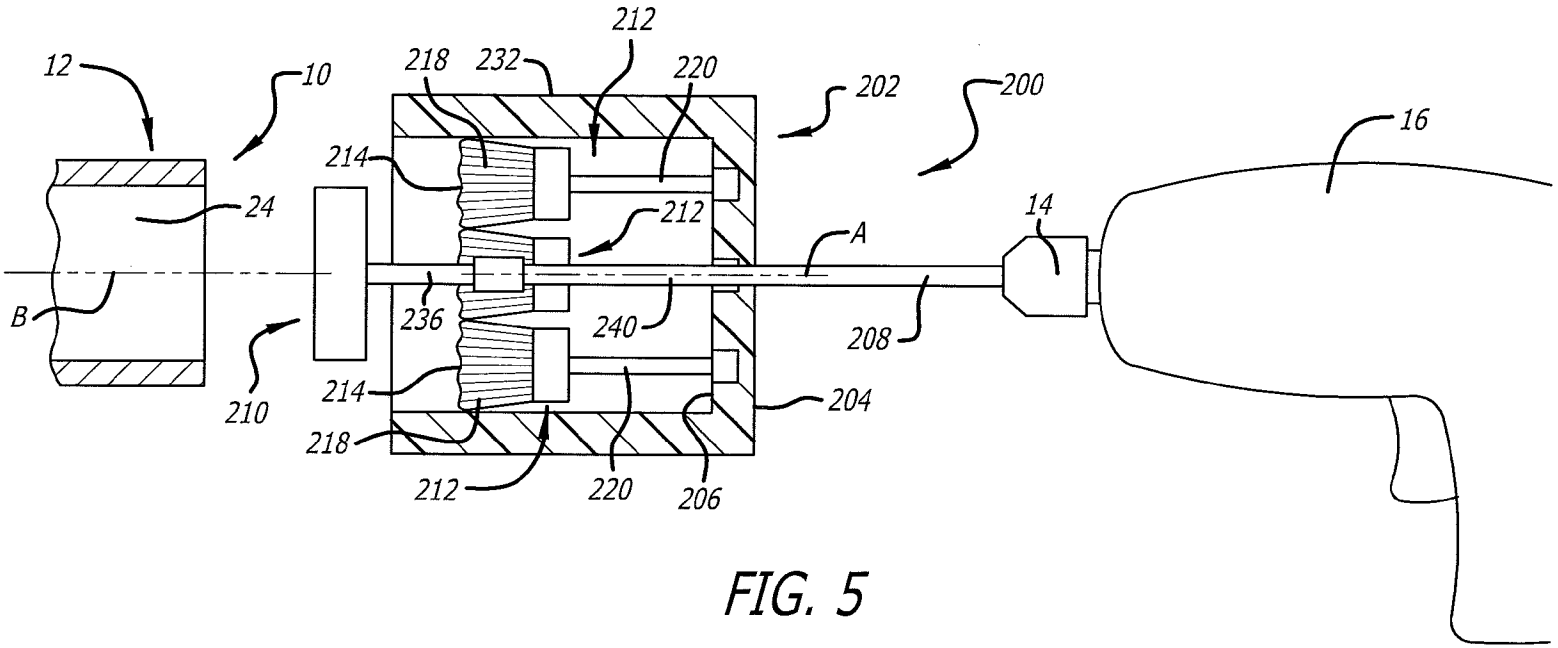

As illustrated in FIGS. 3-14, one example of the present disclosure relates to an abrading apparatus 200 for processing an edge 10 of a tube 12 (e.g., FIG. 5). The abrading apparatus 200 includes a rotational symmetry axis A and a chassis 202, including an input side 204, an output side 206 opposite the input side 204, and an input coupler 208 on the input side 204 of the chassis 202. The chassis 202 may be made from a metal, such as steel or aluminum or its alloys, or from a polymeric material, among other possible constituent materials. The input coupler 208 is coaxial with the rotational symmetry axis A. The abrading apparatus 200 also includes a centering member 210, coupled to the chassis 202 on the output side 206 thereof and coaxial with the rotational symmetry axis A, and abrasive members 212, coupled to the chassis 202 on the output side 206 thereof. The abrasive members 212 include an abrasive face 214 symmetric about the rotational symmetry axis A and facing in a direction generally parallel to the rotational symmetry axis A, which is non-coincident with the abrasive face 214.

Figure 7:
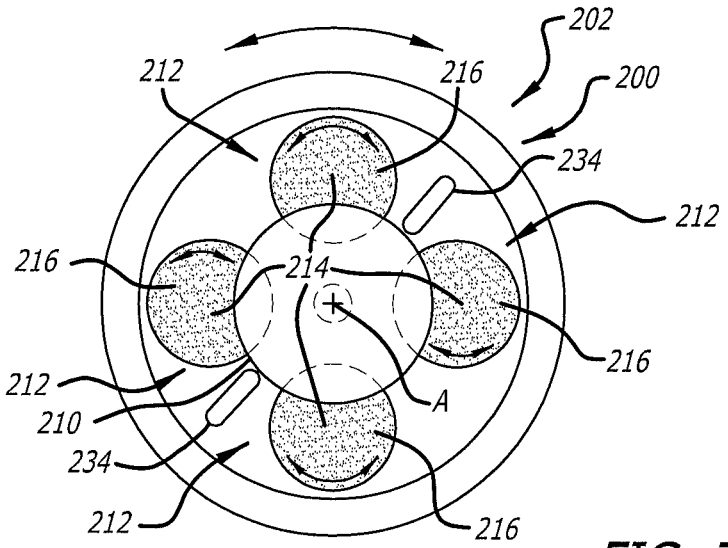

Referring, for example to FIG. 7, in one aspect of the disclosure, which may include at least a portion of the subject matter of any of the preceding and/or following examples and aspects, the abrasive face 214 includes a plurality of discrete regions 216. In other words, the abrasive face 214 is collectively established by the discrete regions 216. The discrete regions 216 may be non-contiguous, as shown in FIG. 7, or alternatively, the abrasive members 212 may be sufficiently closely spaced for the discrete regions 216 to abut and thereby define a substantially continuous abrasive face 214.

Referring, e.g., to FIG. 4, in one aspect of the disclosure, which may include at least a portion of the subject matter of any of the preceding and/or following examples and aspects, the abrasive members 212 include abrasive elements 218 extending generally along the rotational symmetry axis A. In one aspect of the disclosure, which may include at least a portion of the subject matter of any of the preceding and/or following examples and aspects, the abrasive elements 218 are filamentary. The abrasive members 212 may be brushes having metallic filamentary bristles, for example. In the example of FIGS. 3-7, the discrete regions 216 are formed collectively by the ends of the filamentary abrasive elements 218.

Figure 8:
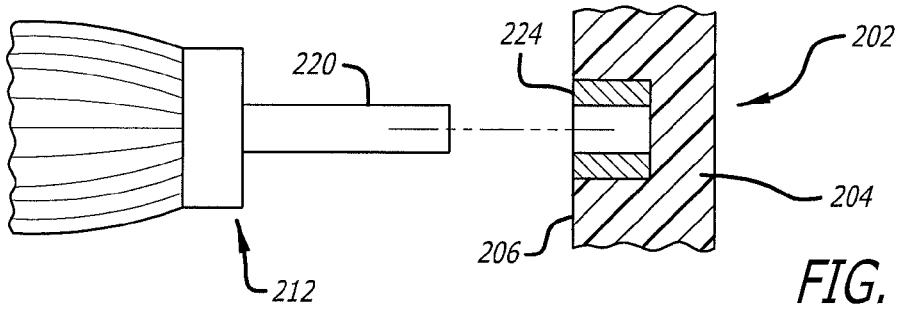
Figure 9:
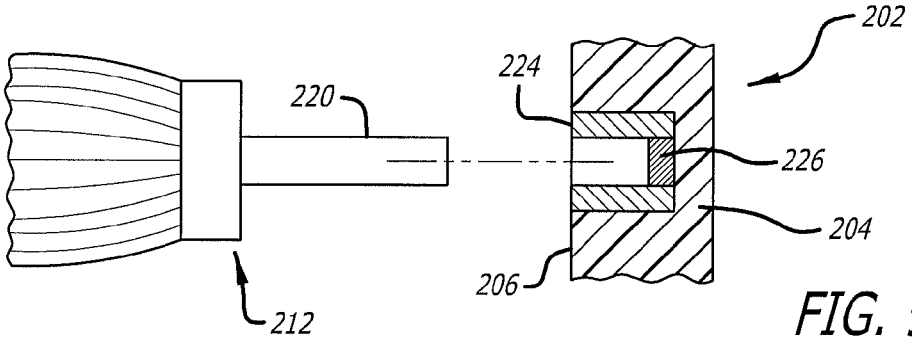
Figure 10:
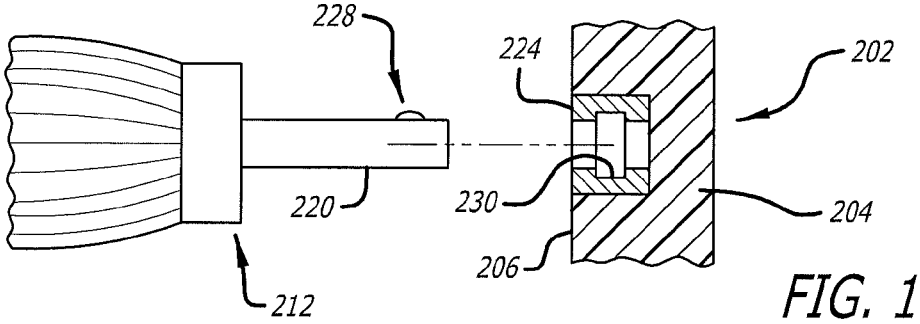

Referring, e.g., to FIGS. 8-10, in one aspect of the disclosure, which may include at least a portion of the subject matter of any of the preceding and/or following examples and aspects, the abrasive members 212 are removably coupled to the chassis 202. As illustrated in FIG. 4, the abrasive members 212 have stems 220 each of which is received within a corresponding socket or receiver 222 containing a bearing 224. As employed herein, bearings 224 may include any suitable friction-reducing element. Illustratively, bearings 224 may encompass sleeves having a friction-reducing treatment, such as burnishing, or a low-friction lining, such as PTFE (polytetrafluoroethylene). Bearings 224 may include, e.g., ball or needle bearings or may comprise a porous material, such as a sintered metal, impregnated with a lubricant. The sockets 222 are anchored within the chassis 202. In one aspect, four sockets 222 containing the bearings 224 are provided, and could accommodate four abrasive members 212, two of which are omitted in FIG. 4 for clarity. The stems 220 may mate with the sockets 222 via a slip fit and may be readily manually insertable into and removable from the sockets 222. Accordingly, abrasive members 212 removably coupled to the chassis are readily renewed.

Referring, e.g., to FIG. 7, in one aspect of the disclosure, which may include at least a portion of the subject matter of any of the preceding and/or following examples and aspects, the abrasive members 212 are rotatably coupled to the chassis 202 to provide even wear of the abrasive members 212. The stems 220 of the abrasive members are caused to rotate within the sockets 222 as a result of contacting the tube 12 (e.g., FIG. 5) as relative rotation of the abrading apparatus 200 and the tube takes place.

Referring now to FIGS. 9 and 10, the abrasive members 212 may be retained within their respective sockets 222, e.g., to prevent inadvertent disengagement of the members 212 from the chassis 202. Yet, in one aspect of the disclosure, which may include at least a portion of the subject matter of any of the preceding and/or following examples and aspects, the members 212 may be coupled to and decoupled from the chassis 202 without tools. In one aspect of the disclosure, which may include at least a portion of the subject matter of any of the preceding and/or following examples and aspects, the apparatus 200 includes magnets 226 (e.g., FIG. 9), which may be retained inside the sockets 222, by adhesion and/or friction. The abrasive members 212 are coupled to the chassis 202 with the magnets 226. More specifically, the magnets 226 magnetically engage the stems 220, fabricated from steel or another magnetically responsive material, of the abrasive members 212. In another aspect, the abrading apparatus includes ball detents 228 (e.g., FIG. 10) and the abrasive members 212 are coupled to the chassis 202 with the ball detents. More specifically, the stems 220 may include ball detents 228 (e.g., FIG. 10). Each ball detent may engage a groove 230 formed in the socket 222.

Referring to FIG. 5, in one aspect of the disclosure, which may include at least a portion of the subject matter of any of the preceding and/or following examples and aspects, the centering member 210 extends farther from the chassis 202 along the rotational symmetry axis A than the abrasive face 214. Referring to FIG. 7, in one aspect of the disclosure, which may include at least a portion of the subject matter of any of the preceding and/or following examples and aspects, the centering member 210 partially overlaps the abrasive members 212 when viewed along the rotational symmetry axis A.

As illustrated in FIG. 4, in one aspect of the disclosure, which may include at least a portion of the subject matter of any of the preceding and/or following examples and aspects, the chassis 202 also includes a partially enclosed housing 232 around the abrasive members to serve as a safety guard and to contain any debris generated during the processing of the tube 12. In one aspect, the housing 232 may be made from a material softer than the tube 12, such as a polymeric material. In an aspect, the housing 232 may be integral with the chassis 202, or alternatively, may be a separate component. In one aspect of the disclosure, which may include at least a portion of the subject matter of any of the preceding and/or following examples and aspects, the chassis 202 also includes at least one through opening 234 in communication with the input side 204 of the chassis 202 and the output side 206 of the chassis 202. A vacuum debris collector (not shown) may be positioned proximate the input side 204 of the abrading apparatus 200 for extracting debris produced during the processing of the tube 12 via the through opening(s) 234.

To prevent marring the interior surface of the tube 12, in one aspect of the disclosure, which may include at least a portion of the subject matter of any of the preceding and/or following examples and aspects, the centering member 210 is non-abrasive. As employed herein, the "non-abrasive" property of the centering member 210 may be achieved by providing the contact surface of the centering member 210 with low-friction characteristics, and/or by configuring the centering member to rotate relative to the chassis 202, but not with respect to the tube 12. Both options will be described.

In one aspect of the disclosure, which may include at least a portion of the subject matter of any of the preceding and/or following examples and aspects, the centering member 210 comprises a non-metallic disc. A non-metallic disc, e.g., one made of a material, such as nylon, having a lower hardness than the tube 12 to be processed, will not mar the interior of a metallic tube 12 if the centering member 210 rotates relative to the tube 12. Alternatively, the centering member may include a non-metallic circumferential surface 211. According to this aspect of the disclosure, which may include at least a portion of the subject matter of any of the preceding and/or following examples and aspects, the core portion of the centering member 210 may be made of a metal, such as aluminum or steel, and may include a non-metallic external sleeve (not shown) to prevent marring of the interior surface of the tube 12.

Referring, e.g., to FIGS. 11-14, in one aspect of the disclosure, the centering member 210 is rotatable relative to the chassis 202 to prevent marring of the interior surface of the tube 12. As illustrated, e.g., in FIGS. 11-13, in one aspect of the disclosure, which may include at least a portion of the subject matter of any of the preceding and/or following examples and aspects, the apparatus 200 includes an output shaft 240 extending from the output side 206 of the chassis 202, and the centering member 210 is coupled to the output shaft 240. In one aspect of the disclosure, which may include at least a portion of the subject matter of any of the preceding and/or following examples and aspects, the output shaft 240 is fixed relative to the chassis 202, and the centering member 210 is rotatably coupled to the output shaft 240. In an aspect of the disclosure, which may include at least a portion of the subject matter of any of the preceding and/or following examples and aspects, the centering member 210 may include a shank 236, which is received in a socket 238 of the output shaft 240. The output shaft 240 is embedded within (e.g., by overmolding, or alternatively, by press fitting) or otherwise fixed to the chassis 202. Rotation of the centering member 210 relative to the chassis 202, accommodated by the socket 238, would enable the centering member 210 not to rotate relative to the tube 12 when the centering member contacts the interior of the tube 12, thereby achieving the "non-abrasive" condition discussed above.

In one aspect of the disclosure, the centering member 210 is configured to be removable from the chassis 202 without tools, e.g., to resize the centering member 210 to accommodate a tube, such as the tube 12, of a different diameter.

Figure 11:
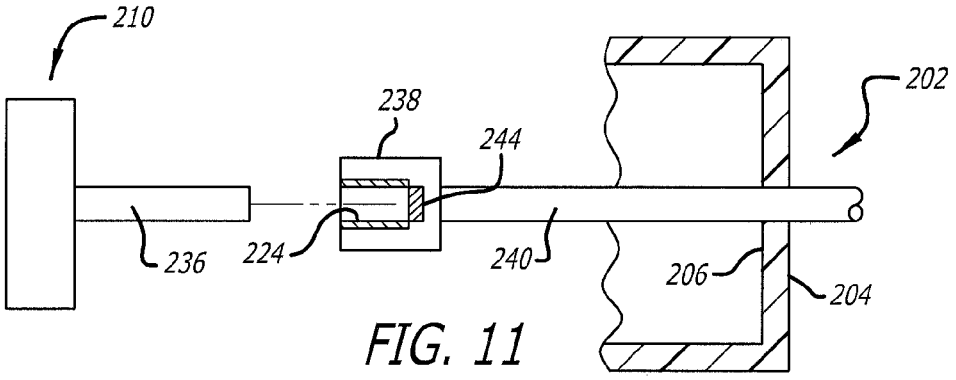

Referring to FIG. 11, in one aspect of the disclosure, the socket 238 may include a bearing 224 to accommodate rotation of the centering member 210 relative to the chassis 202. In one aspect of the disclosure, which may include at least a portion of the subject matter of any of the preceding and/or following examples and aspects, the abrading apparatus 200 includes a magnet 244 secured within the socket 238, and the centering member 210 is coupled to the chassis with the magnet 244, with the shank 236 of the centering member 210 is fabricated from steel or another magnetically responsive material. Referring to FIG. 12, in another aspect of the disclosure, which may include at least a portion of the subject matter of any of the preceding and/or following examples and aspects, the abrading apparatus 200 also includes a ball detent 246, and the centering member 210 is coupled to the chassis 202 with the ball detent 246. The shank 236 of the centering member 210 may be retained within the socket 238 by the ball detent 246, which engages a groove 248 formed in a bearing 224. With reference to FIG. 13, in an aspect of the disclosure, which may include at least a portion of the subject matter of any of the preceding and/or following examples and aspects, instead of a shank 236, the centering member 210 may include a receiver 254 containing a bearing 224. The output shaft 240 fixed to the chassis 202 mates with the receiver 254. Turning to FIG. 14, in one aspect of the disclosure, the shank 236 of the centering member 210 mates with a receiver 258 formed in the chassis 202. The receiver 258 may include a bearing 224.

Turning now to FIG. 5, in one aspect of the disclosure, the input coupler 208 includes a shank. A shank is readily received within a female drive member of a rotary hand-held power source having a female drive, such as a chuck 14 of a hand drill 16 illustrated in FIG. 5. In one aspect of the disclosure, which may include at least a portion of the subject matter of any of the preceding and/or following examples and aspects, the input coupler 208 and the output shaft 240 are integral with each other, e.g., to simplify manufacture of the abrading apparatus 200.

Figure 6:
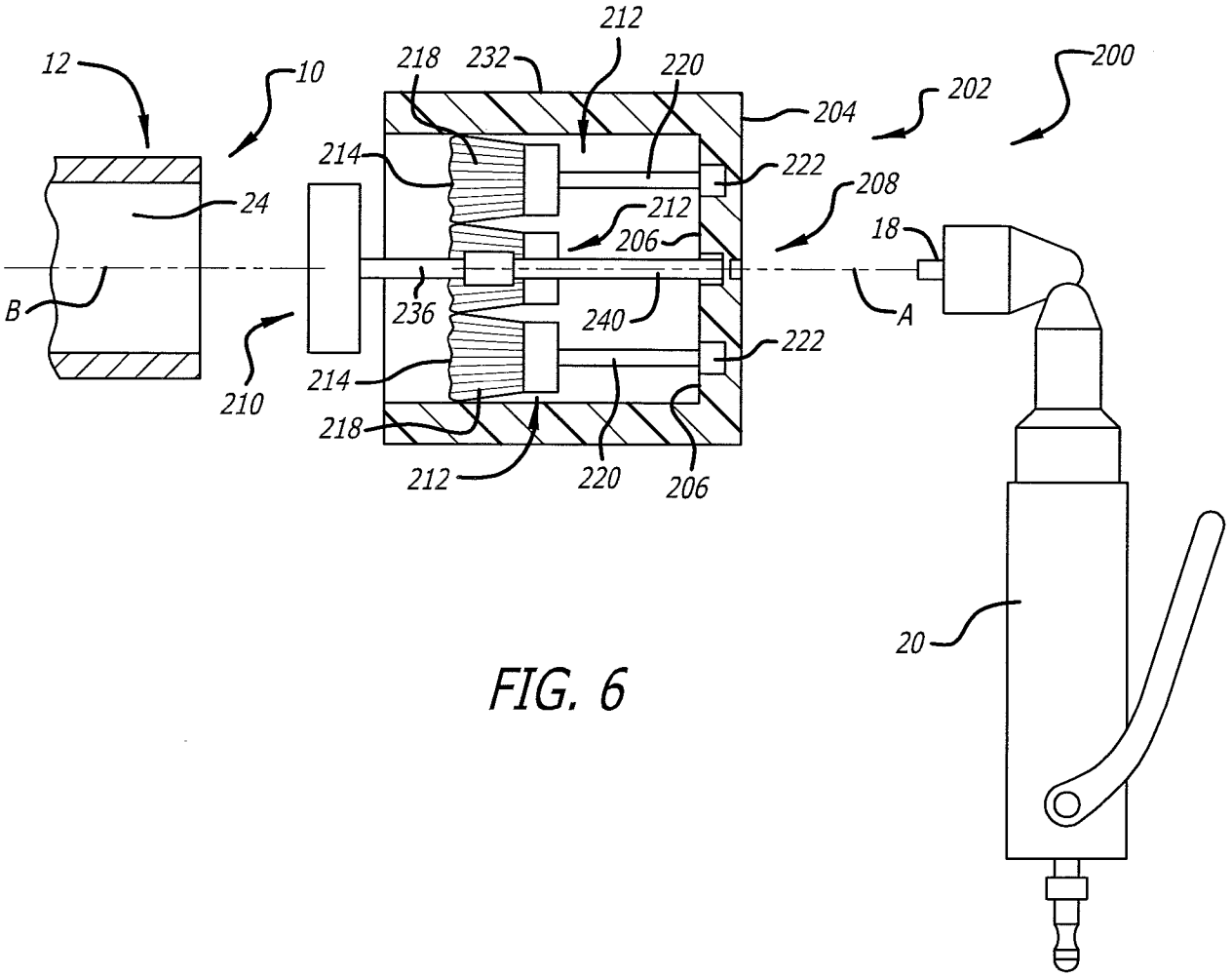

Referring to FIG. 6, in one aspect of the disclosure, the input coupler 208 is formed as a receiver to adapt the abrading apparatus 200 to be coupled to a male drive, such as a square drive 18 of a pneumatic driver 20.

Referring now to FIGS. 15 and 16, another example of the present disclosure relates to an abrading apparatus 200A for processing edges of tubes, such as the tube 12 of FIG. 5. The abrading apparatus 200A may be the structural and functional equivalent of the abrading apparatus 200 illustrated in FIGS. 3-14, but provided with a plurality of centering members, e.g., centering members 210A and 210B, having different transverse dimensions 262, 264 (FIG. 16). The centering members, such as centering members 210A and 210B, are configured to be selectively and alternatively coupled to the output side 206 of the chassis 202 and to be coaxial with the rotational symmetry axis A (e.g., FIG. 4). The centering members are sized to provide a close fit within differently sized tubes, such as the tube 12 of FIG. 5.

Referring primarily to FIG. 17, still another example of the present disclosure relates to a method 201 of processing an edge of the tube 12, which has the symmetry axis B and the central cavity 24. The method 201 includes providing the chassis 202 with abrasive members 212 that include the abrasive face 214, shown, e.g., in FIG. 3 (operation 270); generally coaxially aligning the chassis 202 with the symmetry axis B from inside the central cavity 22, with the abrasive face 214 offset from and facing along the symmetry axis B (operation 272); and urging the abrasive face 214 and the edge 10 of the tube 12 against each other while rotating the chassis 202 and the tube 12 relative to each other (operation 274).

In one aspect of the disclosure, which may include at least a portion of the subject matter of any of the preceding and/or following examples and aspects, the method 201 also includes coupling the chassis 202 to a hand held rotary power source (operation 276), such as the hand drill 16 (FIG. 5) or the pneumatic driver 20 (FIG. 6). In one aspect of the disclosure, which may include at least a portion of the subject matter of any of the preceding and/or following examples and aspects, the method 201 also includes rotatably supporting each one of the abrasive members 212 relative to the chassis 202 (operation 278), such as by providing the bearing 224 (FIG. 8) to support each abrasive member 212. In one aspect of the disclosure, the method also includes generally coaxially aligning the chassis 202 with the symmetry axis B using the centering member 210 positioned inside the central cavity 24 (operation 280). In other words, the rotational symmetry axis A shown in FIG. 4 is generally coaxial with the symmetry axis B. In one aspect of the disclosure, which may include at least a portion of the subject matter of any of the preceding and/or following examples and aspects, the centering member 210 is rotatable relative to the chassis 202, as may be accomplished by providing a bearing, such as the bearing 224 of FIG. 11.

The disclosure and drawing figure(s) describing the operations of the method(s) set forth herein should not be interpreted as necessarily determining a sequence in which the operations are to be performed. Rather, although one illustrative order is indicated, it is to be understood that the sequence of the operations may be modified when appropriate. Additionally, in some aspects of the disclosure, not all operations described herein need be performed.

Different examples and aspects of the apparatus and methods are disclosed herein that include a variety of components, features, and functionality. It should be understood that the various examples and aspects of the apparatus and methods disclosed herein may include any of the components, features, and functionality of any of the other examples and aspects of the apparatus and methods disclosed herein in any combination, and all of such possibilities are intended to be within the spirit and scope of the present disclosure.

Many modifications and other examples of the disclosure set forth herein will come to mind to one skilled in the art to which the disclosure pertains having the benefit of the teachings presented in the foregoing descriptions and the associated drawings.

Therefore, it is to be understood that the disclosure is not to be limited to the specific embodiments disclosed and that modifications and other embodiments are intended to be included within the scope of the appended claims. Moreover, although the foregoing descriptions and the associated drawings describe example embodiments in the context of certain illustrative combinations of elements and/or functions, it should be appreciated that different combinations of elements and/or functions may be provided by alternative implementations without departing from the scope of the appended claims.

The invention claimed is:

1. An abrading apparatus for processing an edge of a tube, the abrading apparatus comprising:

a rotational symmetry axis;

a chassis comprising an input side, an output side opposite the input side, and an input coupler on the input side, wherein the input coupler is coaxial with the rotational symmetry axis;

a centering member, coupled to the chassis on the output side and coaxial with the rotational symmetry axis, wherein:

the centering member is a non-abrasive disc having a non-metallic circumferential surface, and the centering member is rotatable relative to the tube; and abrasive members, coupled to the chassis on the output side, wherein:

each of the abrasive members comprises an abrasive face region perpendicular to the rotational symmetry axis, the rotational symmetry axis is non-coincident with the abrasive face region of any one of the abrasive members, at least one of the abrasive members comprises a stem and abrasive elements extending along the rotational symmetry axis, and the chassis comprises at least one socket adapted to receive the stem.

2. The abrading apparatus of claim 1, wherein abrasive face regions of the abrasive members collectively define an abrasive face.

3. The abrading apparatus of claim 2, wherein the centering member extends farther from the chassis along the rotational symmetry axis than the abrasive face.

4. The abrading apparatus of claim 1, wherein the chassis further comprises a partially enclosed housing around the abrasive members.

5. The abrading apparatus of claim 1, wherein the chassis further comprises at least one through opening in communication with the input side of the chassis and the output side of the chassis.

6. The abrading apparatus of claim 1, wherein the centering member is rotatable relative to the chassis.

7. The abrading apparatus of claim 6, wherein the centering member is configured to be removable from the chassis without tools.

8. The abrading apparatus of claim 1, further comprising an output shaft extending from the output side of the chassis, wherein the centering member is coupled to the output shaft.

9. The abrading apparatus of claim 8, wherein the output shaft is fixed relative to the chassis, and wherein the centering member is rotatably coupled to the output shaft.

10. The abrading apparatus of claim 1, wherein the input coupler comprises a shank.

11. The abrading apparatus of claim 10, further comprising an output shaft on the output side of the chassis, wherein the input coupler and the output shaft are integral with each other.

12. The abrading apparatus of claim 10, wherein the input coupler comprises a receiver.

13. The abrading apparatus of claim 1, wherein the abrasive elements are filamentary.

14. The abrading apparatus of claim 1, wherein the abrasive members are rotatably coupled to the chassis.

15. The abrading apparatus of claim 1, wherein the abrasive members are removably coupled to the chassis.

16. An abrading apparatus for processing edges of tubes, the abrading apparatus comprising:

a rotational symmetry axis;

a chassis comprising an input side, an output side opposite the input side, and an input coupler on the input side, wherein the input coupler is coaxial with the rotational symmetry axis;

centering members configured to be selectively and alternatively coupled to the chassis on the output side and to be coaxial with the rotational symmetry axis, wherein:

at least one of the centering members and at least another one of the centering members have different transverse dimensions, each of the centering members comprises a non-abrasive, non-metallic disc; and abrasive members, coupled to the output side of the chassis, wherein:

each of the abrasive members comprises an abrasive face region perpendicular to the rotational symmetry axis, the rotational symmetry axis is non-coincident with the abrasive face region of any one of the abrasive members, at least one of the abrasive members comprises a stem and abrasive elements extending along the rotational symmetry axis, and the chassis comprises at least one socket adapted to receive the stem.

17. An abrading apparatus for processing an edge of a tube, the abrading apparatus comprising:

a rotational symmetry axis;

a chassis comprising an input side, an output side opposite the input side, and an input coupler on the input side, wherein the input coupler is coaxial with the rotational symmetry axis;

a centering member, coupled to the chassis on the output side and coaxial with the rotational symmetry axis, wherein the centering member is a non-abrasive, non-metallic disc;

abrasive members, coupled to the chassis on the output side, wherein:

each of the abrasive members comprises an abrasive face region perpendicular to the rotational symmetry axis, the rotational symmetry axis is non-coincident with the abrasive face region of any one of the abrasive members; and a housing that partially encloses the abrasive members and extends substantially parallel to the rotational symmetry axis beyond the abrasive face region of each of the abrasive members, the housing being adapted to contain debris traveling perpendicular to the rotational symmetry axis during processing of the edge of the tube.

18. The abrading apparatus of claim 17, wherein the chassis includes at least one through opening in communication with the input side of the chassis and the output side of the chassis.

* * * * *